US010793232B2

(12) United States Patent
Prins

(10) Patent No.: US 10,793,232 B2
(45) Date of Patent: Oct. 6, 2020

(54) SYSTEM TO TRANSFER PEOPLE AND/OR CARGO DURING OFFSHORE OPERATIONS

(71) Applicant: Eagle-Access B.V., Zandvoort (NL)

(72) Inventor: Willem Frederik Prins, Zandvoort (NL)

(73) Assignee: Eagle-Access B.V., Zandvoort (NL)

( * ) Notice: Subject to any disclaimer, the term of this patent is extended or adjusted under 35 U.S.C. 154(b) by 0 days.

(21) Appl. No.: 16/325,239

(22) PCT Filed: Aug. 15, 2017

(86) PCT No.: PCT/NL2017/050538
§ 371 (c)(1),
(2) Date: Feb. 13, 2019

(87) PCT Pub. No.: WO2018/034566
PCT Pub. Date: Feb. 22, 2018

(65) Prior Publication Data

US 2019/0176938 A1 Jun. 13, 2019

(30) Foreign Application Priority Data

Aug. 15, 2016 (NL) ..... 2017314

(51) Int. Cl.
*B63B 27/10* (2006.01)
*B63B 27/30* (2006.01)
(Continued)

(52) U.S. Cl.
CPC ..... *B63B 27/10* (2013.01); *B63B 27/30* (2013.01); *B66C 13/22* (2013.01); *B66C 23/53* (2013.01);
(Continued)

(58) Field of Classification Search
CPC ..... B63B 27/10; B63B 27/30; B63B 27/16; B63B 2017/0072; B66C 13/22; B66C 23/53; B66C 23/76
(Continued)

(56) References Cited

U.S. PATENT DOCUMENTS 4,136,391 A * 1/1979 Eterno ..... B66D 1/525 254/267
4,395,178 A * 7/1983 MacDonell ..... B63B 27/30 114/259
(Continued)

FOREIGN PATENT DOCUMENTS

EP 0039529 A2 11/1981
GB 2336828 * 11/1999 ..... B66C 13/02
(Continued)

*Primary Examiner* — Lynn E Schwenning
(74) *Attorney, Agent, or Firm* — Hoffmann & Baron, LLP

(57) ABSTRACT

A system to transfer people and/or cargo during offshore operations includes a base with a stationary part and a moveable part that is rotatable relative to the stationary part about a substantially vertical first axis; a support arm having a first free end and a second free end opposite the first free end of the support arm; a boom having a first free end and a second free end opposite the first free end of the boom; a load support element; a measurement system; an actuator system; and a control system. The support arm at a location in between the first and second free end of the support arm is mounted to the moveable part of the base such that the support arm is rotatable relative to the moveable part about a substantially horizontal second axis.

20 Claims, 2 Drawing Sheets

(51) Int. Cl.

| | |
|---|---|
| ***B66C 13/22*** | (2006.01) |
| ***B66C 23/53*** | (2006.01) |
| ***B66C 23/76*** | (2006.01) |
| *B63B 27/16* | (2006.01) |
| *B63B 17/00* | (2006.01) |

(52) U.S. Cl.
CPC ..... *B66C 23/76* (2013.01); *B63B 27/16* (2013.01); *B63B 2017/0072* (2013.01)

(58) Field of Classification Search
USPC ..... 414/137.1–143.2
See application file for complete search history.

(56) References Cited

U.S. PATENT DOCUMENTS

| | | | | |
|---|---|---|---|---|
| 6,659,703 | B1 * | 12/2003 | Kirkley | B63B 27/10 414/138.2 |
| 2015/0344110 | A1 * | 12/2015 | van der Tempel | B63B 27/14 114/230.2 |

FOREIGN PATENT DOCUMENTS

| | | | |
|---|---|---|---|
| GB | 2336828 | A | 11/1999 |
| NL | 266662 | A | 8/1964 |
| WO | 2014/068260 | A1 | 5/2014 |
| WO | 2014/155358 | A1 | 10/2014 |

* cited by examiner

SYSTEM TO TRANSFER PEOPLE AND/OR CARGO DURING OFFSHORE OPERATIONS

CROSS-REFERENCE TO RELATED APPLICATIONS

This application is the National Stage of International Application No. PCT/NL2017/050538, filed Aug. 15, 2017, which claims the benefit of Netherlands Application No. NL 2017314, filed Aug. 15, 2016, the contents of which is incorporated by reference herein.

FIELD OF THE INVENTION

The invention relates to a system to transfer people and/or cargo between two objects moving relative to each other, e.g. as encountered in offshore operations, in particular in a safe manner by compensating relative movements between the two objects.

BACKGROUND OF THE INVENTION

With the increasing number of offshore platforms and offshore wind turbines, the need for an easy and cheap system to transfer people and/or cargo to and from these offshore platforms and wind turbines, e.g. for maintenance and installation purposes, has increased.

Prior art systems are usually based on telescopically extendable gangways, but have the disadvantages that they are heavy in weight and that expensive, large and heavy hydraulic actuator systems have to be used that are also low energy efficient.

A further disadvantage of the telescopically extendable gangways may be that, due to their large weight and heavy drives, relative movements cannot be fully compensated by the actuator system. As a result thereof the telescopically extendable gangway requires a physical connection to the platform during the transfer to compensate for the relative movements the actuator system cannot compensate for thus applying considerable and undesired connection forces to the platform. The required physical connection can only be made using a costly specially constructed so-called "landing station". This may have the additional disadvantage that in case of erroneous control of the system or the vessel carrying it, e.g. in case of drift of the vessel, very high forces may be applied to the platform or damage is caused.

Another disadvantage of the telescopically extendable gangways may be that establishing the transfer connection before it is ready for the transfer of people or loads requires considerable time. The same may apply to the retrieval of the gangway, which may take considerable time in which no other activity can take place and which may undesirably add to the time a vessel has to maintain its position.

Yet another disadvantage of the telescopically extendable gangways may be that people have to walk over the gangway, which most of the time is sloped and telescoping while walking over the gangway. This may not be entirely safe.

Yet a further disadvantage of the telescopically extendable gangways may be that they have a limited reach of the free end of the telescopically extendable gangway thus requiring a vessel to maintain its position near a platform to a high degree of accuracy and thus limiting the conditions of weather and waves under which a safe transfer is possible.

A further disadvantage of the telescopically extendable gangways may be that in case a transfer is required to a relatively high location, the entire system usually has to be lifted from the vessel's deck with a rigid, heavy and expensive construction. When the heights increase further, this may require additional compensation in the base to reduce telescoping speeds of the gangways and to provide comfortable feeling of the people being transferred.

Another disadvantage of the telescopically extendable gangways may be that the system requires a lot of space, not only for the constructional components of the system, but also for the separate external hydraulic systems usually provided inside standard transport containers.

GB 2 336 828 discloses a stabilised ship-borne support arm that carries a boom assembly with a capsule for personnel. The arm is connected via a gimbal arrangement to a mounting on a deck of a supply vessel. The arm, the boom and the capsule are controlled in position by hydraulic means, in particular rams, to be manoeuvred to a platform. In order to stabilise the position of the capsule relative to the platform the hydraulic means are dynamically controlled to compensate for movement of the vessel.

A disadvantage herewith is that the dynamic compensation is relatively slow and inaccurate. A long hydraulic chain of motion sensors, software, control equipment, lines, pumps, accumulators, valves, switches, driving engines/actuators, make it impossible in practice to keep a tip of the boom with the capsule connected thereto sufficiently still relative to movements of the vessel. Considerable residual movements always remain at the "compensated" tip which make the placing of the capsule onto the platform very risky. In practice this means that the construction of GB 2 336 828 can only be used when swell is not too rough, when waves are not too high, when the wind is not too strong, when the vessel is not too movable or small, etc. Should it be desired to also use this known construction during more heavy circumstances, then the capsule either needs to be pressed downwards onto the platform either be physical connected thereto.

Another disadvantage is that in GB 2 336 828 the dynamic compensation for roll, pitch and heave is based upon the gimbal arrangement between the arm and the deck mounting. The deck mounting is positioned rotatable around a vertical axis, but a drive for this rotatability around the vertical axis does not form part of the dynamic compensation. In fact this rotatability around the vertical axis is fixed during the manoeuvring of the capsule towards the platform. This means that the compensation of GB 2 336 828 is incomplete. Longitudinal movements and rotational movements of the vessel around a vertical axis do not get compensated for when for example the arm is operative in a position substantially perpendicular to the vessel, which normally is the preferred working position.

SUMMARY OF THE INVENTION

It is therefore an object of the invention to provide an improved system to transfer people and/or cargo during offshore operations, in particular an improved system solving one or more of the abovementioned disadvantages at least partially.

This object is achieved by a system to transfer people and/or cargo during offshore operations, comprising:

a. a base with a stationary part and a moveable part that is rotatable relative to the stationary part about a substantially vertical first axis;
b. a support arm having a first free end and a second free end opposite the first free end of the support arm;
c. a boom having a first free end and a second free end opposite the first free end of the boom;
d. a load support element;

e. a measurement system;

f. an actuator system; and g. a control system, wherein the support arm at a location in between the first and second free end of the support arm is mounted to the moveable part of the base such that the support arm is rotatable relative to the moveable part about a substantially horizontal second axis, wherein the boom at a location in between the first and second free end of the boom is mounted to the first free end of the support arm such that the boom is rotatable relative to the support arm about a substantially horizontal third axis, wherein the load support element is configured to be supported by the first free end of the boom and is configured to support the people and/or cargo during transfer, wherein the measurement system is configured to measure "undesired" relative movement of the load support element relative to a reference, wherein the actuator system is configured to rotate the moveable part relative to the stationary part using a first actuator assembly, to rotate the support arm relative to the moveable part using a second actuator assembly, and to rotate the boom relative to the support arm using a third actuator assembly, wherein the control system is configured to drive the actuator system in dependency of an output of the measurement system to compensate for the "undesired" relative movement of the load support element, wherein the support arm comprises a counterweight at the second free end of the support arm, and wherein the boom comprises a counterweight at the second free end of the boom, and wherein the second and third actuator assemblies comprise electric drives, wherein the counterweight at the second free end of the support arm compensates for at least 25% of a moment applied around the second axis to the support arm, and wherein the counterweight at the second free end of the boom compensates for at least 25% of a moment applied around the third axis to the boom.

With the moment applied around the third axis to the boom for which the counterweight at the second free end of the boom compensates, it is to be understood the sum of sub-moments caused by weight forces of the cabin including people and/or cargo present therein, and of the boom. In other words the moment that is present around the third axis to the boom if the sub-moment caused by the weight force of the counterweight at the second free end of the boom is excluded.

With the moment applied around the second axis to the support arm for which the counterweight at the second free end of the support arm compensates, it is to be understood the sum of sub-moments caused by weight forces of the cabin including people and/or cargo present therein, of the boom, of the counterweight at the second free end of the boom, and of the support arm. In other words the moment that is present around the second axis to the support arm if the sub-moment caused by the weight force of the counterweight at the second free end of the support arm is excluded.

With "undesired" relative movement it is to be understood an unintentional part of a moving of the load support element relative to the reference caused by two objects between which the people and/or cargo need to be transferred, moving relative to each other, for example caused by waves, wind etc. acting upon at least one of them. With "desired" relative movement it is to be understood an intentional part of a moving of the load support element relative to the reference because of the actuator system being driven to have the arm and boom manoeuvre the load support element between the two objects.

An advantage of the system according to the invention is that the use of counterweights to reduce the necessary driving forces allows to use electric drives. This provides the advantage that the system can much quicker and more accurately respond to sudden movements of an offshore object than in case of hydraulic drives. The design can also easily result in a low weight compared to prior art systems resulting in low energy consumption. A long hydraulic chain is lacking in the present invention. Instead the electric drives are simple and direct, and much faster, more exact and more accurate in their operational performance. In practice it has advantageously appeared that the "undesired" relative movements can be reduced with a factor ten compared to the above mentioned known solutions. During a transfer operation the load support element can be positioned with a true touch-and-go principle onto for example a platform or landing station. For example a contact span of 30-40 seconds is well possible.

A further advantage of the system may be that the forces applied to the object supporting the system are relatively low due to its low weight and/or balanced construction.

Another advantage of the system may be that no special landing station is required enabling the system to transfer people and/or cargo to any object because no mechanical adjustments to the object are required. The configuration with the support arm and boom may even allow the load support element to easily pass over obstructions like a fence at a perimeter of a platform, in which case an access door for the fence can be omitted.

Yet a further advantage of the system may be that transfer of people and/or cargo can start directly upon arrival and a vessel may sail away directly after the last transfer, thus saving costly time for the vessel.

Yet another advantage of the system may be that no walking distance needs to be covered and people and/or cargo only needs to be supported by the load support element during transfer.

Another advantage of the system may be that the combination of support arm and boom has a large reach in height and distance allowing to transfer in worse conditions or to operate from smaller livelier vessels and enabling the system to transfer to higher platforms and/or to have a safer larger distance between the two objects.

A further advantage of the system may be that the electric drives can be very energy efficient and the low electric power use of the system enables a direct supply of electricity from the vessel thus minimizing the required space, which may be determined by the base and which may be designed small due to its low weight.

Yet another advantage of the system may be that the landing forces applied to a landing area can be relatively low due to the low-weight, the balanced support arm and boom, and/or accurate control by the electric drives. This may also provide the advantage that in case of erroneous control of the system or vessel supporting it, e.g. in case of drift of the ship, the resulting damage will be low.

It is noted that GB 2 336 828 does not comprise counterweights at free ends of its arm and/or boom. There the boom merely comprises a lever arm for the hydraulic ram to act upon. This lever arm is not destined nor suitable to compensate for a moment applied around a rotation axis to the boom. Instead the lever arm is merely destined to aid in the hydraulic counter balancing of the boom.

According to the present invention the counterweight at the second free end of the support arm in a further preferred embodiment may compensate for at least 50%, and more preferably for at least 75%, of the moment applied around the second axis to the support arm. Likewise in a further preferred embodiment the counterweight at the second free end of the boom may compensate for at least 50%, and more preferably for at least 75%, of the moment applied around the third axis to the boom. This further helps to increase the accuracy and speed of maneuvering operations, and to further reduce the energy consumption of the electric drives.

In a further embodiment the counterweight at the second free end of the support arm preferably may weigh at least 500 kg, and/or the counterweight at the second free end of the boom preferably may weigh at least 500 kg.

The support arm has an operative segment with a first length that extends between the second axis and its first free end, and a free end segment with a second length that extends between the second axis and its second free end. Preferably this second length may be chosen such that it is at least 20% of this first length. The boom has an operative segment with a first length that extends between the third axis and its first free end, and a free end segment with a second length that extends between the third axis and its second free end. Preferably this second length may be chosen such that it is at least 20% of this first length.

The free end segment of the support arm that lies between the second axis and its second free end can be constructed such that it preferably gets to have a weight of at least 250 kg. Likewise, the free end segment of the boom that lies between the third axis and its second free end can be constructed such that it preferably also gets to have a weight of at least 250 kg. Thus the weights of those free end segments can advantageously be part of their corresponding counterweight.

Thus the counterweights and the leverage of the free end segments of the arm and/or boom lower the driving forces in such a way that more simple electric drives can be used and greater accuracy and speed can be achieved for maneuvering the arm and/or boom owing to shorter chains of driving means.

In an embodiment, the first actuator assembly also comprises an electric drive.

According to the invention, the second actuator assembly further comprises a cable extending between the moveable part of the base and the second free end of the support arm to be paid out or hauled in by the corresponding electric drive. Preferably, the electric drive is arranged on the second free end of the support arm, so that the electric drive can be part of the corresponding counterweight.

According to the invention, the third actuator assembly further comprises a cable extending between the first free end of the support arm and the second free end of the boom to be paid out or hauled in by the corresponding electric drive. Preferably, the electric drive is arranged on the second free end of the boom, so that the electric drive can be part of the corresponding counterweight.

In an embodiment, the counterweight at the second free end of the support arm does not fully compensate the moment applied around the second axis to the support arm. As a result thereof, the support arm will always tend to topple 'forward' thereby possibly tending towards a storage position and, if applicable, keep the cable taut in between the moveable part of the base and the second free end of the support arm.

The counterweight at the second free end of the support arm in particular can be chosen such that it does not compensate for between 1-10%, more in particular between 1-5%, of the moment applied around the second axis to the support arm. In addition thereto or in the alternative the counterweight can be chosen such that it does not compensate for between 50-150 kg weight load at the first free end of the support arm. Thus it can be reliably guaranteed that there is always sufficient tension on the cable for the electric drive to have the support arm quickly rotate in either one direction for compensation movements.

In an embodiment, the counterweight at the second free end of the boom does not fully compensate the moment applied around the third axis to the boom. As a result thereof, the boom will always tend to topple 'forward' thereby possibly tending towards a storage position and, if applicable, keep the cable taut in between the first free end of the support arm and the second free end of the boom.

The counterweight at the second free end of the boom in particular can be chosen such that it does not compensate for between 1-10%, more in particular between 1-5%, of the moment applied around the third axis to the boom. In addition thereto or in the alternative the counterweight can be chosen such that it does not compensate for between 50-150 kg weight load at the first free end of the boom. Thus it can be reliably guaranteed that there is always sufficient tension on the cable for the electric drive to have the boom quickly rotate in either one direction for compensation movements.

The load support element can have all kinds of shapes, but preferably is formed by a cage with at least one access door, making it safe for personnel to get transferred. Such a cage can be constructed with an open frame work, but also can be constructed as a substantially closed cabin.

The support arm and/or the boom are preferably embodied as frame works. Thus they get less sensitive for wind forces, while at a same time their weight can be further reduced and the performances of the entire system can be further improved in terms of accuracy and speed. In the alternative they can also be constructed with a more closed construction.

In an embodiment the load support element can be connected to the boom by means of cables or chains. This gives flexibility to the connection and makes it well possible to absorb or cushion any remaining small residual movements at the tip of the boom once the load support element, like for example a cage or cabin, is placed on the other object.

The load support element can be connected to the boom in various ways, but preferably is connected swingable or rotatable thereto, in particular with a rotation drive unit and/or a damper acting between them.

The invention also relates to a vessel provided with a system according to the invention.

The invention further relates to a method for transferring people or cargo between a first object and a second object using a system according to the invention, comprising the following steps:

a. moving the load support element from the first object to a position in between the first and second object;
b. compensating relative movements between load support element and second object;
c. moving the load support element to the second object for transfer while compensating the relative movements between load support element and second object; and
d. allowing the people or cargo to transfer to or from the second object.

In an embodiment, the system is arranged on the first object.

Alternatively, the system may be arranged on a third object, wherein prior to step a. the following steps may be performed:

1. moving the load support element from the third object to a position in between the first and third object;
2. compensating relative movements between load support element and first object;
3. moving the load support element to the first object while compensating the relative movements between load support element and first object; and
4. allowing the people or cargo to transfer from the first object.

In an embodiment, the system is arranged on a third object, wherein after step d. the following steps are performed:

1. moving the load support element away from the second object to a position in between the first and second object while compensating the relative movements between load support element and second object;
2. stopping the compensation of the relative movements between load support element and second object;
3. compensating relative movements between load support element and first object;
4. moving the load support element to the first object while compensating the relative movements between load support element and first object; and
5. allowing the people or cargo to transfer to the first object.

In an embodiment, prior to step a., the load support element may be loaded with people or cargo, wherein the loading of the load support element with people or cargo preferably can be done from any position within its reach.

Step c., 3. and/or step 8. may further comprise positioning the load support element on the corresponding first or second object.

In an embodiment, the method further comprises the following steps:

a. moving the load support element away from the second object to a position in between the first and second object while compensating the relative movements;
b. stopping the compensation of the relative movements; and
c. moving the load support element to the first object.

Step g. may further comprise positioning the load support element on the first object.

After step g., people or cargo may also be transferred from or to the first object.

In an embodiment, the first object is a vessel and the second object is an offshore platform.

In an embodiment, the first object is a vessel and the second object is a person or the cargo itself. This embodiment in particular relates to a rescue or recovery operation in which the person or cargo is in the water, e.g. after falling of a vessel or platform, and needs to be rescued or recovered, respectively.

In such a situation, compensation of the relative movements between load support element and person or cargo in the water may be carried out using a camera system on the load support element that regularly or continuously captures images of the person or cargo and intends to keep that image steady, i.e. to keep the image of the person of cargo steady within the frame. An advantage thereof is that full compensation is possible as the person or cargo also acts as the reference itself. However, the earth itself may act as reference thereby allowing at least partial compensation.

The above described application of the system according to the invention is also possible due to the use of a combination of support arm and boom which allows to reach the water level of the surrounding water of the vessel.

In an embodiment, the first object is a vessel and the second object is another vessel, so that people, for instance a maritime pilot, and/or cargo can be transferred from one vessel to another vessel.

The invention will now be described in a non-limiting way by reference to the accompanying drawings.

DETAILED DESCRIPTION OF THE INVENTION

Figure 1:
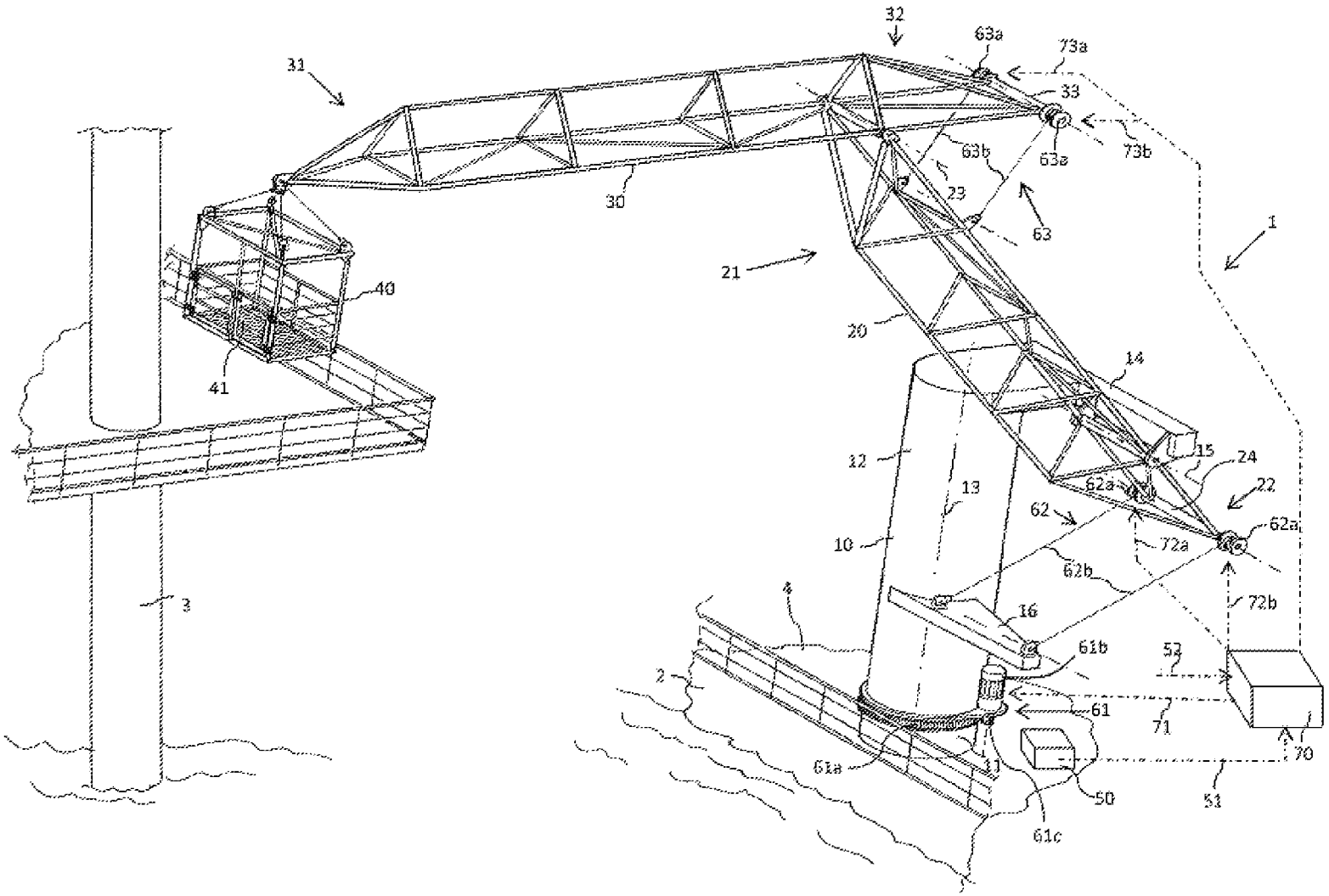
FIG. 1 depicts a system to transfer people and/or cargo during offshore operations according to an embodiment of the invention.

FIG. 1 depicts a system 1 for transferring people and/or cargo during offshore operations according to an embodiment of the invention. Offshore operations may include the transfer of people and/or cargo from a vessel 2 to a fixed construction 3, e.g. a platform or other fixed offshore installation, and/or vice versa. However, offshore operations may also include transfer of people and/or cargo between two vessels, and rescue or recovery operations to retrieve people and/or cargo from the water. Hence, system 1 is preferably used in cases in which there are undesired relative movements between two objects preventing an easy transfer of people and/or cargo.

In this embodiment, the system is mounted on a deck 4 of the vessel 2, but alternatively, the system 1 could have been mounted on the fixed construction 3.

The system 1 comprises a base 10, a support arm 20, a boom 30, a load support element 40, a measurement system 50, an actuator system, and a control system 70.

The measurement system 50 and the control system 70 have been schematically indicated for simplicity reasons. Dashed lines indicate inputs and outputs to the measurement system 50 and the control system 70, respectively. The skilled person will understand that other locations and/or embodiments of the measurement system and control system are possible, and is well-familiar with practical implementations of the required functions, so that these will not be elucidated here.

The base 10 comprises a stationary part 11 mounted to the deck 4 of the vessel 2, and a moveable part 12 that is rotatable relative to the stationary part 11 about a substantially vertical first axis 13. The stationary part 11 may also be mounted indirectly to the deck, e.g. via a support frame or a pedestal, which support frame or pedestal may also be used for other purposes.

It is explicitly noted here that the stationary part 11 being mounted to the deck of the vessel does not necessarily mean that the stationary part 11 cannot be moved over the deck. It may well be the case that the stationary part 11 is moveable over the deck of the vessel to move the system 1 between an operational position, e.g. at a side of a vessel to get closer to another object, and a rest position, e.g. in a centre of a vessel for improved stability during sailing.

The stationary part 11 may further be integrated with the deck 4 of the vessel 2, but may also be a frame to be placed as a self-supporting unit on the deck 4.

To rotate the moveable part 12 relative to the stationary part 11, the actuator system comprises a first actuator assembly 61, here embodied in the form of a slewing ring 61*a* with external tooth gear arranged on the stationary part 11 cooperating with an electric drive 61*b* that drives a gear 61*c* engaging with the slewing ring 61*a*, wherein the electric drive 61*b* and the gear 61*c* are arranged on the moveable part 12.

It will be apparent for the skilled person that the first actuator assembly 61 can also be embodied in other forms, e.g. the slewing ring 61*a*, electric drive 61*b* and gear 61*c* can also be arranged internally of the moveable and stationary parts 11, 12. Further, more than one electric drive and corresponding gear can be provided. Also, the slewing ring can be provided on the moveable part 12 and the electric drive and gear can be provided on the stationary part. Other actuator principles are also envisaged.

The support arm 20 has a first free end 21 and a second free end 22 opposite the first free end 21 of the support arm 20.

The moveable part 12 of the base 10 comprises a first support beam 14 to which the support arm 20 can be connected at a location in between the first 21 and second 22 free end of the support arm. The support beam 14 defines a substantially horizontal second axis 15 allowing the support arm 20 to rotate relative to the moveable part 12 of the base 10 about said second axis 15.

In order to rotate the support arm 20 relative to the moveable part 12 of the base 10, the actuator system is provided with a second actuator assembly 62 comprising in this embodiment, two electrically driven winches 62*a* arranged on the second free end 22 of the support arm 20 and two corresponding cables 62*b* that extend between the winches 62*a* on the support arm 20 and the moveable part 12. Moveable part 12 is therefore provided with a beam 16 so that the connection of the cable 62*b* can be aligned with its corresponding winch 62*a*.

An advantage of using two winches 62*a* and corresponding cables 62*b* may be that there is redundancy in case one of the winches 62*a* or cables 62*b* fails, is replaced or maintenance is carried out on one of the winches 62*a* or cables 62*b*.

Rotation of the support arm 20 is thus possible by paying out or hauling in the cables 62*b* using the respective winches 62*a*.

The first axis 13 of the base 10 does not intersect the support arm 20 due to the fact that the support arm 20 is connected to the moveable part 12 via the support beam 14 extending sideways from a main body of the moveable part 12. This has the advantage that the rotational movement of the support arm 20 about the second axis 15 is not limited by the main body of the moveable part 12, so that the support arm 20 for instance can also be positioned in a substantially vertical orientation parallel to the first axis 13.

The boom 30 has a first free end 31 and a second free end 32 opposite the first free end 31 of the boom 30.

The boom 30 is connected to the first free end 21 of the support arm 20 at a location in between the first free end 31 and the second free end 32 of the boom. The support arm 20 at this location defines a substantially horizontal third axis 23 allowing the boom 30 to rotate relative to the support arm 20 about said third axis 23.

In order to rotate the boom 30 relative to the support arm 20, the actuator system is provided with a third actuator assembly 63 comprising in this embodiment, two electrically driven winches 63*a* arranged on the second free end 32 of the boom 30 and two corresponding cables 63*b* that extend between the winches 63*a* on the boom 30 and the first free end 21 of the support arm 20.

Rotation of the boom 30 is thus possible by paying out or hauling in the cables 63*b* using the respective winches 63*a*.

Again, an advantage of using two winches 63*a* and corresponding cables 63*b* may be that there is redundancy in case one of the winches 63*a* or cables 63*b* fails, is replaced or maintenance is carried out on one of the winches 63*a* or cables 63*b*.

The load support element 40 is configured to be supported by the first free end 31 of the boom 30 and is configured to support the people and/or cargo during transfer. In this embodiment, the load support element is embodied as a cage 40 with at least one access door 41.

The load support element 40 may be permanently connected to the boom 30, but may also be temporarily connected allowing to use the system with different types of load support elements depending on the type of transfer. Further, it allows to leave the load support element behind after transfer. This allows for instance to limit the use of the entire system and/or for the vessel carrying the system to perform other tasks, possibly at another location, in between subsequent transfers.

In an embodiment, the load support element 40 comprises tubing and/or hoses at least connected to the first free end of the boom allowing to transfer fluid material, e.g. grout or cement. However, applications may also be limited to transferring solid goods and/or people, where solid goods also comprise liquids or powder held in solid containers or bags.

As mentioned before, system 1 is preferably used in cases in which there are undesired relative movements between two objects preventing an easy transfer of people and/or cargo between those two objects. In the embodiment of FIG. 1 this relative movement is caused by sea- and/or wind-induced movement of the vessel 2 while the fixed construction is not movable.

As a result of these undesired relative movements, the load support element 40 will move relative to fixed construction 3 in an uncontrollable manner, which will make it very difficult to move and position the load support element 40 with respect to the fixed construction 3. There will be a high risk of collision with damage as a result.

In order to compensate for the undesired relative movements, the system 1 is provided with the measurement system 50 configured to measure directly or indirectly the undesired relative movement of the load support element 40 relative to a reference. This can be done in various ways, including direct and indirect ways, for instance:

1) by measuring the relative motions of the vessel 2 or stationary part 11 using e.g. gyroscopes. The earth itself then acts as reference, but as the fixed construction 3 is directly arranged on the ground, the fixed construction 3 can also be considered to be the reference; and/or
2) by measuring relative movements of the vessel 2 directly with respect to the fixed construction, e.g. by using laser measurements systems, for instance based on laser interferometry in which a laser beam is reflected of between the fixed construction 3 and the vessel 2.

Relative movements may be measured by measuring acceleration, velocity and/or position relative to the reference as long as these measurements can be used to compensate for the relative movements.

An output of the measurement system 50, here indicated by dashed arrow 51, which is representative for the relative movements, is fed to the control system 70. Another input may be user input indicated by dashed arrow 52, which may represent desired movements or relative positions of the load support element 40.

The control system 70 is configured to drive the actuator system in dependency of the output 51 of the measurement system to compensate for the undesired relative movement of the load support element 40. As a result, if there is no desired movement of the load support element 40, the load support element 40 will be stationary relative to the fixed construction 3 although the vessel 2 carrying the load support element will move due to wave and wind action.

In addition to the compensation, the control system 70 may be configured to control the position of the load support element 40 relative to the fixed construction 3, i.e. the reference, based on a desired position or movement of the load support element, which desired position can be based on user input.

In the embodiment of FIG. 1, the control system 70 provides drive signals to the electric drives of the first, second and third actuator assemblies as indicated by the dashed arrows 71, 72*a*, 72*b*, 73*a* and 73*b*.

Due to the offshore situation, it is expected that there will be undesired movements continuously. This means that the actuator assemblies are continuously driven to move the moveable part 12 of the base 10 (and everything supported thereby), the support arm 20 and the boom 30.

To keep the driving forces within limits, the support arm 20 comprises a counterweight 24 at the second free end 22 of the support arm, and the boom comprises a corresponding counterweight 33 at the second free end 32 of the boom 30.

As described above, the winches 62*a* of the second actuator assembly and the winches 63*a* of the third actuator assembly are arranged on the respective second free ends of the support arm 20 and the boom 30, thereby also functioning as counterweights.

The support arm 20 and the boom 30 are configured such that the counterweights do not fully compensate the moment applied to the respective first ends of the support arm 20 and the boom 30 so that the cables 62*b* and 63*b* of respectively the second and third actuator assemblies are kept taut at all times of the operation.

An advantage of the system 1 according to the invention is that the total weight of the system can be kept low. In combination with the presence of the counterweights, the necessary forces to drive the system can also be kept low, so that energy efficient electric drives can be utilized instead of energy inefficient hydraulic drives.

Although the support arm and the boom have been embodied as frame works, it will be apparent for the skilled person that they at least partially can easily be embodied as box elements or as beam type elements, etc.

Figure 2:
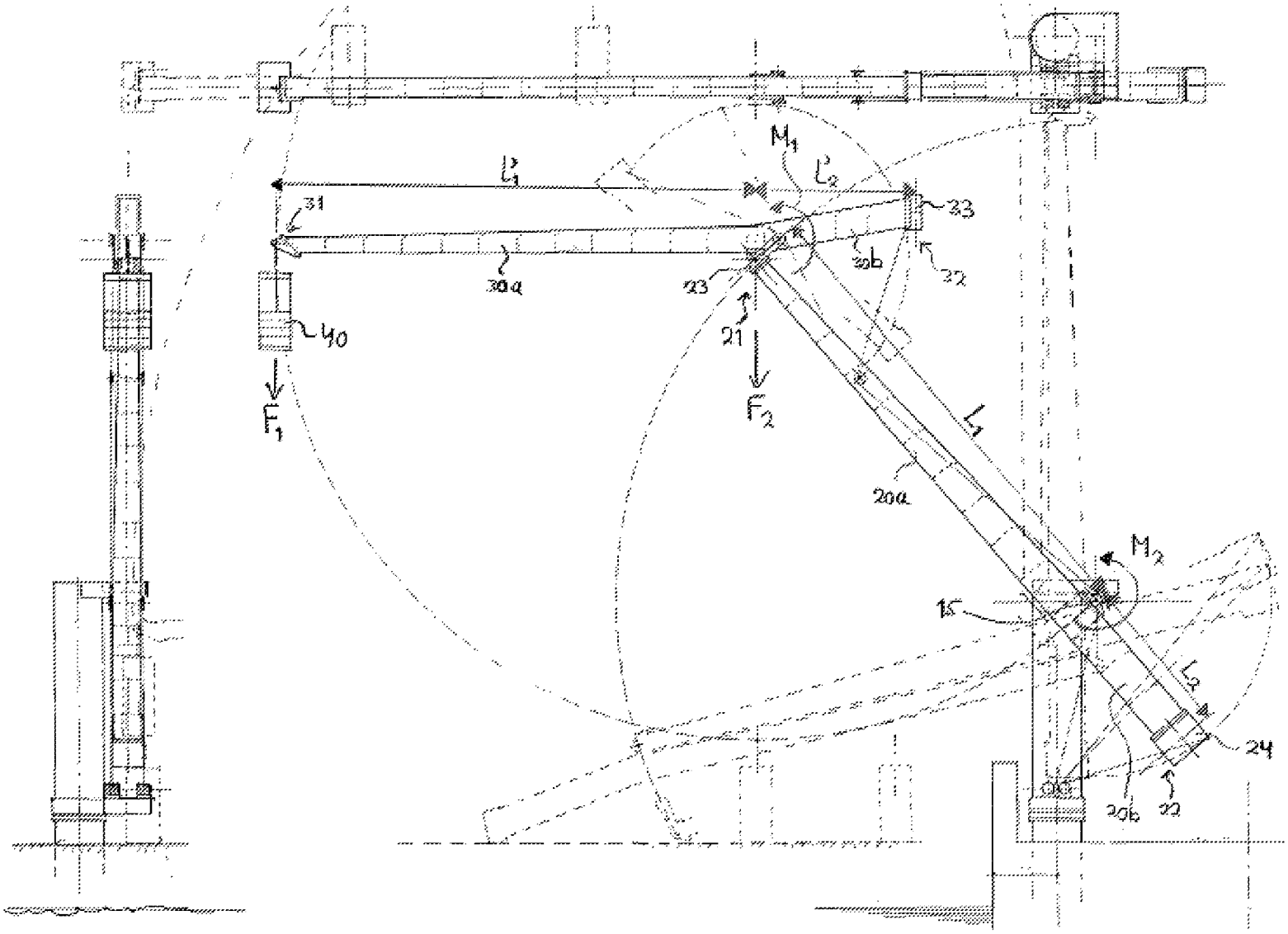
FIG. 2 shows front, upper and side views of an alternative embodiment of the system.

In FIG. 2 same components have been given the same reference numerals. Here an embodiment is shown in which the arm 20 and the boom 30 are embodied as beam types. Here it is also clearly indicated that the arm 20 has an operative segment 20*a* with a first length L1 that extends between the second axis 15 and its first free end 21, and a free end segment 20*b* with a second length L2 that extends between the second axis 15 and its second free end 22. The length L2 here is chosen to be larger than 20%, and in particular about 33%, of the length L1.

Likewise it is clearly indicated here that the boom 30 has an operative segment 30*a* with a first length L1' that extends between the third axis 23 and its first free end 31, and a free end segment 30*b* with a second length L2' that extends between the third axis 23 and its second free end 32. The length L2' here is chosen to be larger than 20%, and in particular about 33%, of the length L1'.

As an example the cabin 40 may have a weight of about 500 kg, while the operative segment 30*a* of the boom 30 may have a weight of 700 kg. The free end segment 30*b* of the boom 30 then may have a weight of at least 250 kg, in particular about 500 kg, whereas the counterweight 33 mounted thereto may have weight of at least 500 kg, in particular about 750 kg. Thus the counterweight 33 at the second free end 32 of the boom 30 compensates for at least 75%, in particular between 95-99%, of a moment M1 applied around the third axis 23 to the boom 30. At the same time the counterweight 33 does not compensate for the entire moment M1 applied around the third axis 23 to the boom 30. In particular it does not compensate for between 1-5% of this moment M1 and leaves a remaining weight load F1 of between 50-150 kg at the first free end 31 of the boom 30, also depending on the weight of the people and/or cargo that is present inside the cabin 40.

With this it is noted that the moment M1 around the third axis 23 to the boom 30 comprises the sum of sub-moments caused by:

- a weight force of the cabin 40 including people and/or cargo present therein times a horizontal distance between its centre of gravity and to the third axis 23; and
- a weight force of the operative segment 30*a* times a horizontal distance between its centre of gravity and to the third axis 23.

This moment M1 is partly compensated by:

- a weight force of the free end segment 30*b* times a horizontal distance between its centre of gravity and the third axis 23; and
- a weight force of the counterweight 33 times a horizontal distance between its centre of gravity and the third axis 23.

Furthermore as an example the operative segment 20*a* of the arm 20 may have a weight of 2100 kg. The free end segment 20*b* of the arm 20 then may have a weight of at least 250 kg, in particular about 1500 kg, whereas the counterweight 24 mounted thereto may have weight of at least 500 kg, in particular about 2500 kg. Thus the counterweight 24 at the second free end 22 of the arm 20 compensates for at least 75%, in particular between 95-99%, of a moment M2 around the second axis 15 to the arm 20. At the same time the counterweight 24 does not compensate for the entire moment M2 around the second axis 15 to the arm 20. In particular it does not compensate for between 1-5% of this moment and leaves a remaining weight load F2 of between 50-150 kg at the first free end 21 of the arm 20, again also depending on the weight of the people and/or cargo that is present inside the cabin 40.

With this it is noted that the moment M2 around the second axis 15 to the arm 20 comprises the sum of sub-moments caused by:

- the weight force of the cabin 40 including people and/or cargo present therein times a horizontal distance between its centre of gravity and the second axis 15;
- the weight force of the operative segment 30*a* times a horizontal distance between its centre of gravity and the second axis 15;
- the weight force of the free end segment 30*b* times a horizontal distance between its centre of gravity and the second axis 15;
- the weight force of the counterweight 33 times a horizontal distance between its centre of gravity and the second axis 15; and a weight force of the operative segment 20*a* times a horizontal distance between its centre of gravity and the second axis 15.

This moment M2 is partly compensated by:

a weight force of the free end segment 20*b* times a horizontal distance between its centre of gravity and the second axis 15; and a weight force of the counterweight 24 times a horizontal distance between its centre of gravity and the second axis 15.

Since the arm 20 also carries the boom 30 with the cabin 40 and the counterweight 33, and thus also needs to be compensated for their weight forces, the weight of the free end segment 20*b* of the arm 20 and/or the weight of the counterweight 24 preferably are chosen larger than the weight of the free end segment 30*b* of the boom 30 and/or the weight of the counterweight 33, in particular at least two times larger, more in particular at least three times larger.

Although the first rotation axis is defined as being substantially vertical and the second and third axis are defined as being substantially horizontal, an alternative definition may be that the second and third axis are parallel to each other, but perpendicular to the first axis, or that the first, second and third axis are oriented such that a 3DOF, where each DOF is a translation, positioning system is obtained.

Reference is made in this description to the term counterweight. Although any mass being present at an opposite side of a pivot axis may be considered a counterweight, counterweights according to the invention compensate for at least 25% of the moment, preferably for at least 50% of the moment and more preferably for at least 75% of the moment.

The invention claimed is:

1. A vessel provided with a system to transfer people and/or cargo during offshore operations, the system comprising:

a) a base with a stationary part and a moveable part that is rotatable relative to the stationary part about a substantially vertical first axis;

b) a support arm having a first free end and a second free end opposite the first free end of the support arm;

c) a boom having a first free end and a second free end opposite the first free end of the boom;

d) a load support element that is configured to be loaded with people and/or cargo;

e) a measurement system;

f) an actuator system; and g) a control system, wherein the support arm at a location in between the first and second free end of the support arm is mounted to the moveable part of the base such that the support arm is rotatable relative to the moveable part about a substantially horizontal second axis, wherein the boom at a location in between the first and second free end of the boom is mounted to the first free end of the support arm such that the boom is rotatable relative to the support arm about a substantially horizontal third axis, wherein the load support element is configured to be supported by the first free end of the boom and is configured to support the people and/or cargo during transfer, wherein the measurement system is configured to measure relative movement of the load support element relative to a reference, wherein the actuator system is configured to rotate the moveable part relative to the stationary part using a first actuator assembly, to rotate the support arm relative to the moveable part using a second actuator assembly, and to rotate the boom relative to the support arm using a third actuator assembly, wherein the control system is configured to drive the actuator system in dependency of an output of the measurement system to compensate for the relative movement of the load support element, wherein the support arm comprises a counterweight at the second free end of the support arm, wherein the boom comprises a counterweight at the second free end of the boom, wherein the second and third actuator assemblies comprise secondary and tertiary electric drives, wherein the counterweight at the second free end of the support arm compensates for at least 25% of a moment (M2) that is present around the second axis to the support arm and that is equal to a sum of sub-moments caused by weight forces of the load support element, including people and/or cargo present therein during a transfer operation, of the boom, of the counterweight at the second free end of the boom, and of the support arm, wherein the counterweight at the second free end of the boom compensates for at least 25% of a moment (M1) that is present around the third axis to the boom and that is equal to a sum of sub-moments caused by the weight forces of the load support element, including people and/or cargo present therein during a transfer operation, and of the boom, wherein the second actuator assembly further comprises a cable extending between the moveable part of the base and the second free end of the support arm to be paid out or hauled in by the corresponding electric drive, and wherein the third actuator assembly further comprises a cable extending between the first free end of the support arm and the second free end of the boom to be paid out or hauled in by the corresponding electric drive.

2. The vessel provided with a system according to claim 1, wherein the counterweight at the second free end of the support arm compensates for at least 50% of the moment (M2) that is present around the second axis to the support arm and that is equal to the sum of sub-moments caused by the weight forces of the load support element, including people and/or cargo present therein during a transfer operation, of the boom, of the counterweight at the second free end of the boom, and of the support arm, and/or wherein the counterweight at the second free end of the boom compensates for at least 50% of the moment (M1) that is present around the third axis to the boom and that is equal to the sum of sub-moments caused by the weight forces of the load support element, including people and/or cargo present therein during a transfer operation, and of the boom.

3. A vessel provided with a system according to claim 1, wherein the support arm has an operative segment with a first length that extends between the second axis and the first free end, and wherein the support arm has a free end segment with a second length that extends between the second axis and the second free end, wherein the second length is at least 20% of the first length, and/or wherein the boom has an operative segment with a first length that extends between the third axis and the first free end, and in which the boom has a free end segment with a second length that extends between the third axis and the second free end, wherein the second length is at least 20% of the first length.

4. A vessel provided with a system according to claim 1, wherein the first actuator assembly comprises a primary electric drive.

5. The vessel provided with a system according to claim 1, wherein the secondary electric drive is arranged on the second free end of the support arm.

6. The vessel provided with a system according claim 1 wherein the tertiary electric drive is arranged on the second free end of the boom.

7. The vessel provided with a system according to claim 1, wherein the counterweight at the second free end of the support arm does not fully compensate the moment (M2) that is present around the second axis to the support arm and that is equal to the sum of sub-moments caused by the weight forces of the load support element, including people and/or cargo present therein during a transfer operation, of the boom, of the counterweight at the second free end of the boom, and of the support arm.

8. The vessel provided with a system according to claim 7, wherein the counterweight at the second free end of the support arm does not compensate for between 1-10% of the moment (M2) that is present around the second axis to the support arm and that is equal to the sum of sub-moments caused by the weight forces of the load support element, including people and/or cargo present therein during a transfer operation, of the boom, of the counterweight at the second free end of the boom, and of the support arm, and/or does not compensate for between 50-150 kg weight load at the first free end of the support arm.

9. The vessel provided with a system according to claim 1, wherein the counterweight at the second free end of the boom does not fully compensate the moment (M1) that is present around the third axis to the boom and that is equal to the sum of sub-moments caused by the weight forces of the load support element, including people and/or cargo present therein during a transfer operation, and of the boom.

10. The vessel provided with a system according to claim 9, wherein the counterweight at the second free end of the boom does not compensate for between 1-10% of the moment (M1) that is present around the third axis to the boom and that is equal to the sum of sub-moments caused by the weight forces of the load support element, including people and/or cargo present therein during a transfer operation, and of the boom, and/or does not compensate for between 50-150 kg weight load at the first free end of the boom.

11. The vessel provided with a system according to claim 1, wherein the load support element is a cage with at least one access door.

12. The vessel provided with a system according to claim 1, wherein the support arm and/or the boom are embodied as a frame work.

13. The vessel provided with a system according to claim 1, wherein the load support element is connected to the boom by means of cables or chains.

14. The vessel provided with a system according to claim 1, wherein the load support element is connected swingable to the boom, and/or wherein the load support element is connected rotatable to the boom, in particular with a rotation drive unit and/or a damper acting between them.

15. A method for transferring people or cargo between a first object and a second object using a system comprising:

a base with a stationary part and a moveable part that is rotatable relative to the stationary part about a substantially vertical first axis;

a support arm having a first free end and a second free end opposite the first free end of the support arm;

a boom having a first free end and a second free end opposite the first free end of the boom;

a load support element that is configured to be loaded with people and/or cargo;

a measurement system;

an actuator system; and a control system, wherein the support arm at a location in between the first and second free end of the support arm is mounted to the moveable part of the base such that the support arm is rotatable relative to the moveable part about a substantially horizontal second axis, wherein the boom at a location in between the first and second free end of the boom is mounted to the first free end of the support arm such that the boom is rotatable relative to the support arm about a substantially horizontal third axis, wherein the load support element is configured to be supported by the first free end of the boom and is configured to support the people and/or cargo during transfer, wherein the measurement system is configured to measure relative movement of the load support element relative to a reference, wherein the actuator system is configured to rotate the moveable part relative to the stationary part using a first actuator assembly, to rotate the support arm relative to the moveable part using a second actuator assembly, and to rotate the boom relative to the support arm using a third actuator assembly, wherein the control system is configured to drive the actuator system in dependency of an output of the measurement system to compensate for the relative movement of the load support element, wherein the support arm comprises a counterweight at the second free end of the support arm, wherein the boom comprises a counterweight at the second free end of the boom, wherein the second and third actuator assemblies comprise secondary and tertiary electric drives, wherein the counterweight at the second free end of the support arm compensates for at least 25% of a moment (M2) that is present around the second axis to the support arm and that is equal to a sum of sub-moments caused by weight forces of the load support element, including people and/or cargo present therein during a transfer operation, of the boom, of the counterweight at the second free end of the boom, and of the support arm, wherein the counterweight at the second free end of the boom compensates for at least 25% of a moment (M1) that is present around the third axis to the boom and that is equal to a sum of sub-moments caused by the weight forces of the load support element, including people and/or cargo present therein during a transfer operation, and of the boom, wherein the second actuator assembly further comprises a cable extending between the moveable part of the base and the second free end of the support arm to be paid out or hauled in by the corresponding electric drive, and wherein the third actuator assembly further comprises a cable extending between the first free end of the support arm and the second free end of the boom to be paid out or hauled in by the corresponding electric drive, said method comprising the following steps:

a) moving the load support element from the first object to a position in between the first and second object;

b) compensating relative movements between load support element and second object;

c) moving the load support element to the second object for transfer while compensating the relative movements between load support element and second object; and d) allowing people or cargo to transfer to or from the second object.

16. The method according to claim 15, wherein the system is arranged on the first object and wherein the first object is a vessel.

17. The method according to claim 15, further comprising the steps of:

e) moving the load support element away from the second object to a position in between the first and second object while compensating the relative movements;

f) stopping the compensation of the relative movements; and g) moving the load support element to the first object.

18. The method according to claim 15, wherein the system is arranged on a third object, wherein the third object is a vessel, and wherein prior to step a) the following steps are performed:

a1) moving the load support element from the third object to a position in between the first and third object;

a2) compensating relative movements between load support element and first object;

a3) moving the load support element to the first object while compensating the relative movements between load support element and first object; and a4) allowing people or cargo to transfer from the first object.

19. The method according to claim 15, wherein the system is arranged on a third object, wherein the third object is a vessel, and wherein after step d) the following steps are performed:

a5) moving the load support element away from the second object to a position in between the first and second object while compensating the relative movements between load support element and second object;

a6) stopping the compensation of the relative movements between load support element and second object;

a7) compensating relative movements between load support element and first object;

a8) moving the load support element to the first object while compensating the relative movements between load support element and first object; and a9) allowing people or cargo to transfer to the first object.

20. The method according to claim 15, wherein the first object is a vessel and wherein the second object is an offshore platform.

* * * * *